US008408959B2

(12) United States Patent
Wickham

(10) Patent No.: US 8,408,959 B2
(45) Date of Patent: Apr. 2, 2013

(54) COLLAPSIBLE FLOATATION SYSTEM

(76) Inventor: David Hirbe Wickham, Madison, OH (US)

( * ) Notice: Subject to any disclaimer, the term of this patent is extended or adjusted under 35 U.S.C. 154(b) by 0 days.

(21) Appl. No.: 12/820,447

(22) Filed: Jun. 22, 2010

(65) Prior Publication Data

US 2011/0312235 A1 Dec. 22, 2011

Related U.S. Application Data

(60) Provisional application No. 61/209,080, filed on Dec. 24, 2009.

(51) Int. Cl.
*B63C 9/26* (2006.01)

(52) U.S. Cl. ..... 441/84

(58) Field of Classification Search ..... 441/80, 441/84, 85, 88

See application file for complete search history.

(56) References Cited

U.S. PATENT DOCUMENTS

| | | | | |
|---|---|---|---|---|
| 292,281 | A * | 1/1884 | Brewster | 441/84 |
| 1,510,595 | A * | 10/1924 | Hodgson | 441/85 |
| 3,974,536 | A * | 8/1976 | Franklin | 441/85 |
| 6,394,528 | B2 * | 5/2002 | Hoenack | 296/136.01 |

FOREIGN PATENT DOCUMENTS

FR 2571331 A1 * 4/1986

* cited by examiner

*Primary Examiner* — Edwin Swinehart
(74) *Attorney, Agent, or Firm* — Brian Asquith

(57) ABSTRACT

Various embodiments and aspects of the disclosed application relates to a rescue device that can be used to assist in rescue of a person or other entity from a body of water. The rescue device comprises a floatation mechanism, a delivery mechanism, and a retrieval mechanism. The rescue device comprises a length of rope having a looped end of rope on which are located one or more floatation component(s), a weight to facilitate delivery of the components comprising the delivery device, and the length of rope facilitates retrieval of the rescue device.

15 Claims, 7 Drawing Sheets

COLLAPSIBLE FLOATATION SYSTEM

CROSS REFERENCE TO RELATED APPLICATIONS

This application claims the benefit of U.S. Provisional Patent application Ser. No. 61/209,080 entitled "COLLAPSIBLE FLOATATION DEVICE" and filed Dec. 24, 2009. The entirety of the above-noted application is incorporated by reference herein.

TECHNICAL FIELD

The subject specification relates generally to delivering a floatation device to a swimmer or other person requiring assistance.

BACKGROUND

Providing assistance to a person who has fallen overboard a boat or a kayaker who has exited from their kayak and is currently swimming in a rapid can be critical in terms of the timeliness and type of assistance provided. Rescuing of individuals partaking in marine and other water based sports can be of a difficult nature with regard to accurate delivery of suitable equipment to facilitate aid to, and retrieval of, a person from the water.

A device conventionally utilized in rescuing a person, e.g., a swimmer, or the like, from a body of water, such as a lake, river, ocean, and the like, is a life-ring buoy (LRB). Traditionally the LRB comprises floatable material having a torus shape (e.g., a doughnut shape). During rescue, the swimmer can hang on to the LRB or position the LRB around their torso (e.g., under their arms) to provide flotation during retrieval of themselves from the body of water. A LRB is typically constructed from a unicellular polyurethane foam (for buoyancy) covered in a durable skin such as polyvinyl chloride, hardshell polyethylene, or the like. Alternatively the LRB can be of a hollow construction where the outer shell is of a rigid material, e.g., a hardshell polyethylene skin. Conventional LRB's, comprising of a hard outer skin, have the potential to be injurious to the person requiring rescue if they are hit by the LRB as it is being thrown to them, e.g., during delivery of the LRB.

Hollow LRBs with a vinyl outerskin are commonplace in environments such as a swimming pool but their lightweight and general lack of sufficient rigidity can render throwing such a LRB to be an inaccurate process with the possibility that the LRB is unable to provide sufficient buoyancy to provide necessary floatation to the person in the water requiring assistance.

Other items can be carried on board a boat such as seat pads which when not being used to provide seating can also be thrown to a swimmer to provide floatation. However, given their fairly non-aerodynamic shape, it can be quite a challenge to accurately deliver a seat pad to a person in the water.

Personal floatation devices (PFD's), lifevests, lifejackets, and the like, are often worn by people when there is a chance of falling into a body of water such as when working near unguarded edges, boarding or leaving small boats, etc. Kayakers, canoeists, rafters, and the like, while not mandated to, will typically wear a PFD to provide extra buoyancy in the event that they are no longer in their kayak/canoe/raft/etc., e.g., as a result of falling out or performing a wet exit. However, even though, for example, a kayaker may have been sufficiently careful to wear a PFD, the river conditions in which they find themselves, e.g., a class V whitewater rapid, could place them in extreme danger of drowning and accurate delivery of some means of floatation and/or rescue is critical to their survival. A device commonly found in such conditions is a throwbag.

A throwbag comprises of a nylon bag which incorporates floatation material and a rope loosely stuffed inside. One end of the rope is typically looped to form a grab loop. A person conducting the rescue will hold onto the grab loop and throw to the swimmer the throwbag containing the remainder of the rope. As the throwbag travels through the air, the remaining rope pays out from the bag. Upon delivery to the swimmer, the swimmer grabs the bag/rope and/or wraps the rope around themselves to enable the person conducting the rescue to pull the swimmer to shore, for example. One concern during the rescue is the swimmer is to grab the rope rather than the bag containing the remaining uncoiled rope. In the latter scenario the rope could continue to uncoil from the bag thereby rendering the "tether" between the rescuer and the swimmer to be ineffective as the swimmer continues to be swept downstream.

SUMMARY

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as a prelude to the more detailed description that is disclosed later.

Various embodiments and aspects of the disclosed application relates to a rescue device that can be used to assist in rescue of a person or other entity from a body of water. The rescue device comprises a floatation mechanism, a delivery mechanism, and a retrieval mechanism.

In one embodiment the rescue device can comprise of a floatation ring comprising of one or more floats arranged on a looped end of a tether. The loop of floats can be opened up to form a circle of floats on the tether which a person can hold onto or place over their body. To facilitate delivery, a delivery mechanism can be attached to the loop thereby providing weight to enable the float and tether to be thrown. By having the weight on the loop this can provide the necessary weight to deliver the float while allowing the float to comprise of a softer material. The weight can comprise of a bag within which is contained a weighted material in the form of a particulate such as, for example, grains of sand or glass beads. Particulate weight in a bag allows the weight to be distributed over an area upon impact as opposed to a point impact, thereby reducing the risk of injury.

In another embodiment, the necessary weight to allow delivery of the floats can be incorporated into the floats that comprise the loop. In a further embodiment, the distribution of the weights can be arranged amongst the floats to enable accurate delivery of the floats.

In a further embodiment, for example where size of the floatation device might be an issue, memory foam as incorporated into such a device as a sleeping mat employed by backpackers, campers, and the like could be employed. In one aspect, each of the floats could be covered with an airtight/semi-airtight cover, such as nylon, which can allow ingress of air through the nylon material or in another aspect the nylon covers could include a valve that allows air to flow into the void created by the expanding foam thereby allowing the foam to take on the expanded form.

While in storage, e.g., the floatation device is stored in a bag, the floats could be compressed. Upon removal from the bag, the floatation foam expands to form the final shape.

The floats, rope, rope loop, and any necessary weights could be carried in a bag comprising of two halves. The two halves can be separated with the necessary floats, rope and any weights retained in one half of the bag. The bag and its contents could then be delivered to a locale, e.g. location of a person in distress, by human or mechanical means. By having the floats, rope loop, and weight (as necessary) contained and distributed in the bag, the bag and contents can be delivered further and accurately than if the floats, rope loop, and weight were thrown without the bag owing to such effects as minimizing wind resistance, decreased surface area, etc.

DETAILED DESCRIPTION

Figure 1A:
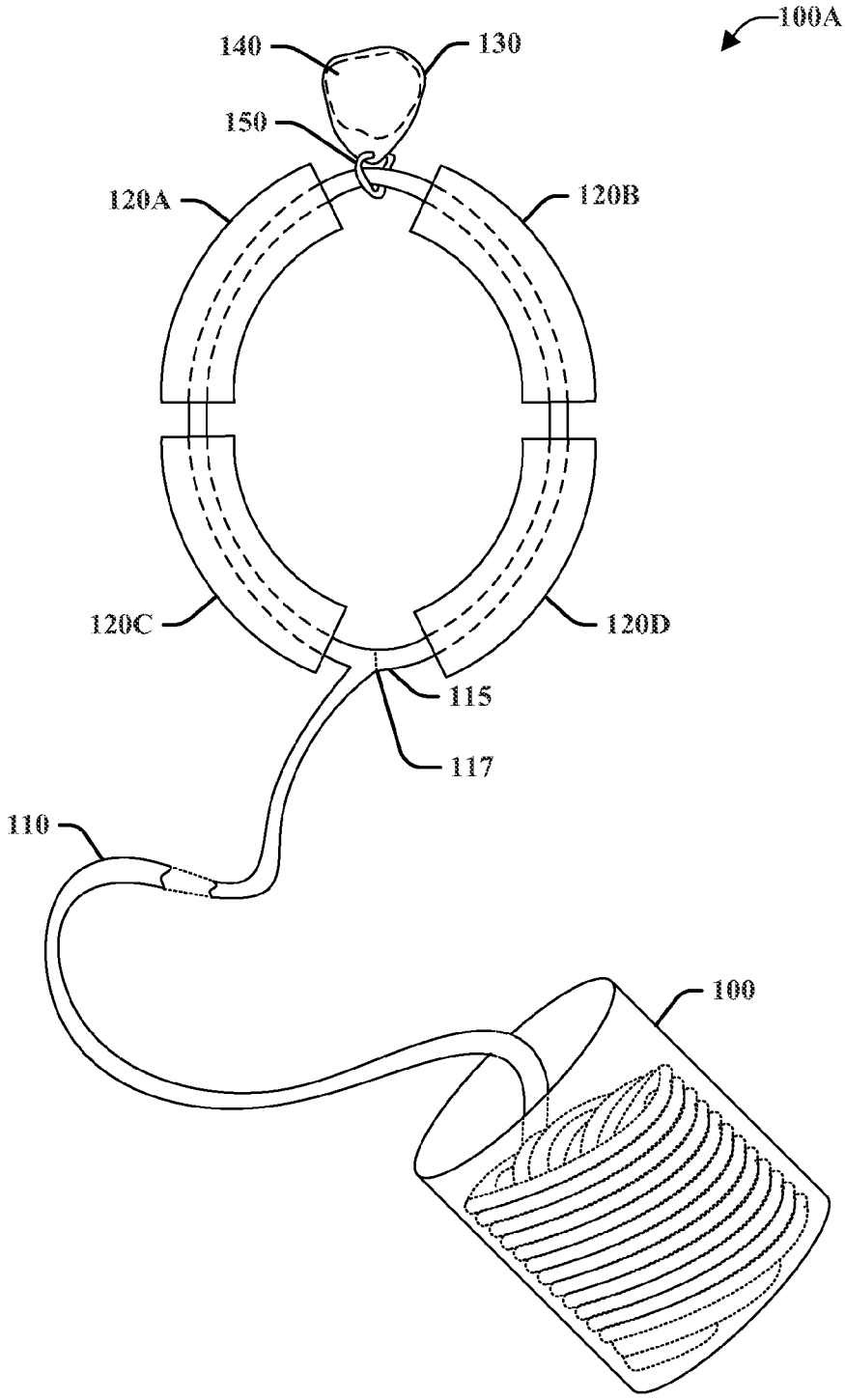
FIG. 1A illustrates a system 100A to render aid and/or rescue of a person or other entity in accordance with an aspect.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It can be evident, however, that the claimed subject matter can be practiced without these specific details. In other instances, well-known structures and devices are shown in block diagram form in order to facilitate describing the claimed subject matter.

The subject application relates various apparatus, systems and methods to facilitate aid and rescue of a person. An aspect to effect rescue of a person or other entity is the delivery of a rescue device in close proximity to the person or entity requiring assistance.

It is to be appreciated that while the term "person" is used throughout the subject application, the scope of the application is not so limited and encompasses any entity that can be assisted by application of the various embodiments of the subject application as disclosed herein. For example the subject application could be used to assist in the rescue of an animal, such as dog, cat, horse, dolphin, etc. Further, it is to be appreciated that while the various apparatus, systems and methods as disclosed herein are not limited to the act of rescuing a person or other entity. The various disclosed embodiments can be used in a variety of circumstances. For example the disclosed embodiments can be employed in situations of play, e.g., pulling a person through the water, as well as distress such as rescuing a person from a body of water, and the like. It is to be further appreciated that while, for the purposes of discussion, the various embodiments disclosed herein are discussed in a situation of rescuing a person or other entity from a body of water, the subject application is not so limited. For example, envisaged application of the various disclosed embodiments include rescue of a person from a body, of saltwater such as a sea, ocean, estuary, etc., as well as volumes of freshwater such as stream, river, lake, and the like. Further environments of application could be assisting a person caught in quicksand or other similar environment, as well as a person trapped in snow, along with a person requiring rescue from a precarious location such as a rock face, cliff, building, and the like.

Furthermore, while various examples of materials suitable for employment in the construction and manufacture of the various embodiments are disclosed herein, it is to be appreciated that the list of suitable materials is not so limited. Any material can be employed that offers any desired physical and material properties to facilitate construction, manufacture and operation of the disclosed embodiments.

FIG. 1A illustrates a system 100A to facilitate assistance and/or rescue of a person or other entity based on various aspects as disclosed infra. System 100A comprises of a container 100, a rope 110, floatation components 120A-120D, and a weightbag 130 containing weighted material 140 attached to the rope 110 by connector 150.

Container 100 can be constructed from any suitable material to provide storage of other components comprising system 100. Construction of container 100 can be such that it is rigid, semi-rigid, flexible, or combination thereof. A variety of materials having the desired properties (e.g., physical, chemical, mechanical, etc.) can be employed to construct container 100, such as metal, polymer, ceramic, wood, glass, carbon fiber, fiberglass, and the like, or combination thereof. Materials selection can be based upon desired rigidity, strength, weight, corrosion resistance, UV resistance, ease of manufacture, etc. In one embodiment, container 100 can be of a rigid construction. In rigid form the container 100 can include a carrying handle (not shown) and a lid (not shown) with the various components of system 100A being carried in container 100. Further, container 100 can be of a semi-rigid or flexible nature functioning as a bag in which are stored components comprising system 100. As indicated supra, a variety of materials, both man-made or naturally occurring, can be employed to facilitate construction of the container to impart the desired properties, for example a flexible bag could be constructed from nylon material. When designed as a flexible bag, the various components of system 100 can be stored within container 100 and secured therein by means of a drawstring (not shown) or similar device such as buckled strap, Velcro, and the like. For operation the securing mechanism can be undone and the necessary rope 110, floatation components 120A-D, weight system 130-150, etc. can be removed for use.

While container 100 is indicated to be a part of system 100A, it is to be appreciated that container 100 is not required to facilitate effective utilization of other components which comprise system 100. In one embodiment container 100 provides a receptacle in which to store other components which comprise system 100.

In situations where system 100A is employed to facilitate rescue from a body of water, such as ocean, river, lake, and the like, it is considered that rope 110 would be constructed from a low density material with sufficient strength to facilitate floatation of the rope 110 on the body of water. Suitable low density materials include, but are not limited to, polypropylene, high modulus polyethylene (HMP), aramid, or other man-made or naturally occurring material that provides a desired property such as floatation, strength, ductility, and the like. Further, rope 110 can be comprised of a plurality of strands or fibres, or the rope 110 can be of a monofilament material.

As depicted in FIG. 1A, rope 110 has been constructed to form a loop 115 onto which are located a plurality of floatation components 120A-120D. In one embodiment the floatation components 120A-120D can be of a tubular form thereby facilitating threading of the rope 110 through each floatation component 120A-120D. Once the required number of floatation components 120 are located on the rope 110, an end 117 of the rope can be secured on a portion of the rope 110 to form a loop 115 on which the floatation components 120A-120D are located.

It is to be appreciated that while FIG. 1A illustrates a system comprising of four floatation components 120A-120D, the subject application is not so limited; the number of floatation components 120 to be utilized can range from a single floatation component through to a plurality of floatation components N, where N is an integer greater than 1. The floatation components 120 can be manufactured from any material having desired properties of weight (density), floatation, rigidity, strength, corrosion resistance, useable life, and the like. Suitable materials include naturally occurring materials such as cork, balsa, and the like, manmade materials such as expanded polystyrene, expanded polyethylene, closed cell foam, floatation foam, and the like, or a combination thereof. As described above, the floatation components 120 can be constructed from a floatation material, such as closed cell polyethylene foam, in a tubular form (commonly called a swimming pool noodle) with the rope 110 being threaded through the tubular floatation component(s) 120. In one aspect, a plurality of floatation components 120 allows the floatation device to be folded down to facilitate ease of storage and transportation compared with a LRB having a torus shape.

In another aspect, rope 110 can be manufactured to form a desired loop 115 and floatation components 120 secured thereon by various means of attachment such as clipping on, tying on, being cast onto rope 110, thermoforming, etc. It is envisaged that any suitable means can be employed to attach a floatation component 120 to rope 110.

System 100A further comprises a weightbag 130 (containing weight 140, and attached to the rope 110 by connector 150), which can be employed to deliver the rope 110 and the floatation component(s) 120 to a desired location, e.g., the locale of a swimmer in a body of water. The weight 140 is of sufficient mass such that it allows the various components which comprise any of the embodiments disclosed herein to be delivered with sufficient momentum to overcome any forces acting on the system 100A that may affect delivery, such as wind resistance resulting from ambient wind, air resistance acting on the various components, gravity, etc. It is to be appreciated that while system 100A (and systems 100B, 100C, 200, 300, and 400) depict a single weight system (e.g., components 130, 140, and 150) a plurality of weight systems can be attached to the rope loop.

As discussed above, of concern is the prevention of injury to a person due to being struck with a rescue device. For example, there is a risk of a person being struck and injured when they are trying to catch or retrieve a LRB having a hardshell polyethylene skin. To minimize such risk, the weight 140 contained in the weightbag 130, can comprise of any suitable weighting material such as sand, dirt, pebbles, lead shot, polymer shot, glass beads, and the like, that provide a desired weight to facilitate delivery of the system 100A to the desired location. To minimize the risk of injury it is considered that the weighting material 140 be in a granular, pellet, beaded, or other small size such that if the weightbag 130 impacts a person the impact force (momentum) of the weightbag 130 and weight 140, contained therein, is distributed across the surface area of the weightbag 130 contacting the person, thereby minimizing a single point impact and the possibility of injury.

In one embodiment, the weightbag 130 can be designed to be resealable thereby allowing weighting material 140 to be added to the weightbag 130 on an as needed basis. For example, the weightbag 130 can be empty during transportation but can be filled at the location of use, e.g., a kayaker could carry an empty weightbag 130 during transportation to a river, and then prior to setting off the kayaker could fill the weightbag 130 with sand (weight 140) found on the shore of the river.

In an aspect the weightbag 130 can be connected to the rope 110 by any suitable means such as having the weightbag 130 designed so that it can be tied onto the rope 110. Alternatively the weightbag 130 can be secured by means of a connector 150 such as a karabiner, ziptie, rope, string, link, and the like.

Figure 1B:
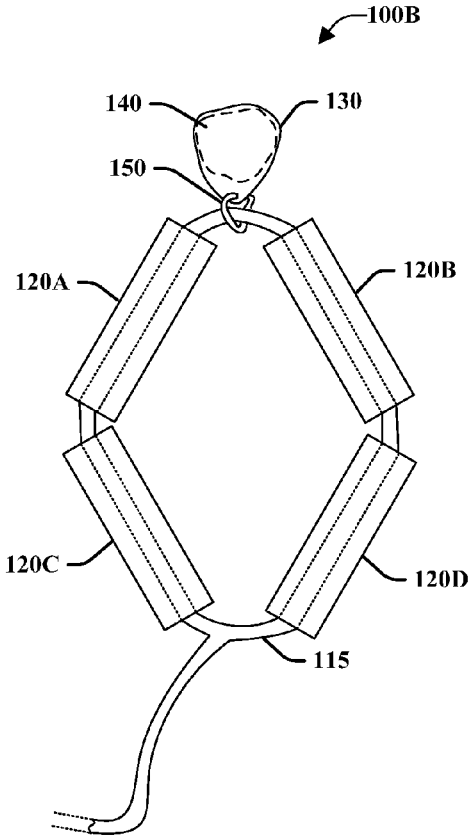
FIG. 1B illustrates a system 100B to render aid and/or rescue of a person or other entity in accordance with an aspect.
Figure 1C:
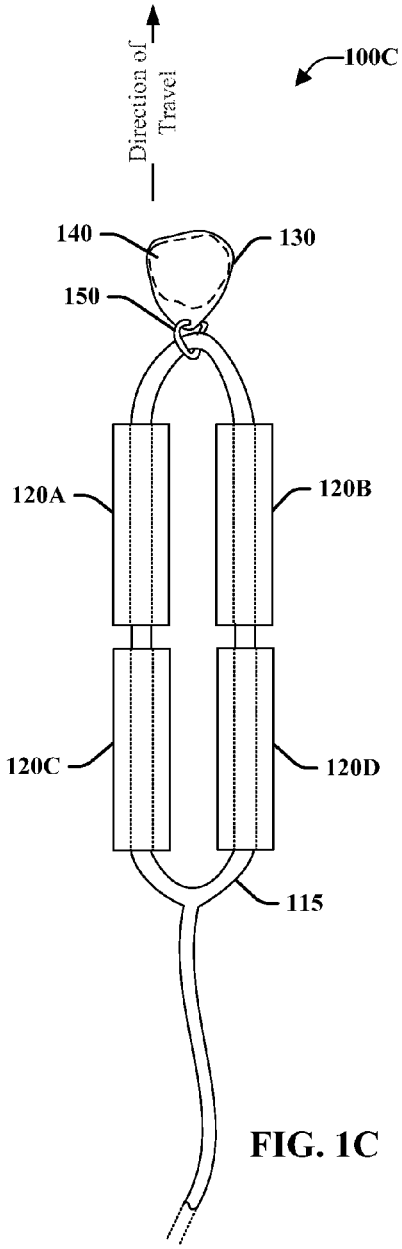
FIG. 1C illustrates a system 100C to render aid and/or rescue of a person or other entity in accordance with an aspect.

Turning briefly to FIGS. 1B and 1C which depict systems 100B and 100C respectively and present alternative embodiments and aspects of FIG. 1A. The floatation components 120A-120D can be of any suitable shape. In FIG. 1A the floatation components 120A-120D are depicted as being curved tubes while in FIG. 1B the floatation components 120A-120D are illustrated as comprising of straight tubes. FIG. 1B is presented to clarify that the floatation components can be of any effective shape and cross-section.

FIG. 1C illustrates system 100C, which depicts how the weightbag 130 and the floatation components 120A-120D may align themselves on the tethered rope 110 during delivery of system 100C. As can be seen, the weightbag 130 (and weight 140) is attached to the rope 110 by connector 150, and proceeds the rope 110 and floatation components 120A-120D during delivery of system 100C. It is to be appreciated that depending upon the actual configuration of weightbag 130, floatation components 120A-120D, connector 150, and rope 110, the actual order with which system 100C components arrive at a target site may be different from that depicted in FIG. 1C.

Figure 2:
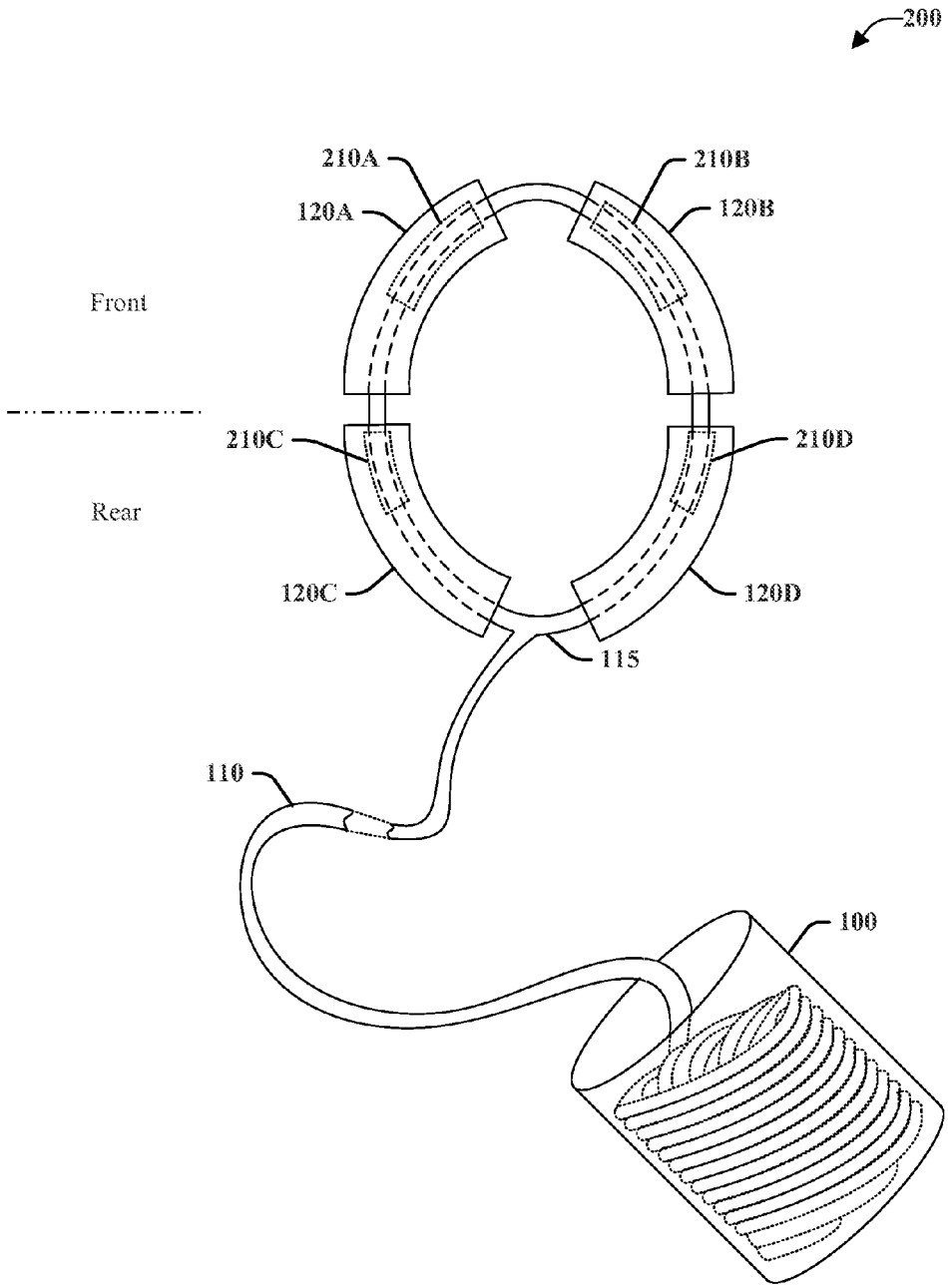
FIG. 2 illustrates a system 200 to facilitate aid and/or rescue of a person or other entity in accordance with an aspect.

FIG. 2 illustrates a system 200 that facilitates assistance and/or rescue of a person or other entity. System 200 shares components common with systems 100A-100C in terms of the container 100, rope 110, and floatation components 120. As can be seen, system 200 does not include a weightbag 130, weight 140 or connector 150. In system 200, rather than a weighted mass (FIG. 1, weightbag 130, weight 140, and connector 150) being attached separately to the rope 110, weight(s) 210A-210D have been incorporated into the floatation components 120. The required weight to facilitate delivery of system 200 to, for example, a person who has fallen overboard or in another situation of distress, is distributed between one or more of floatation components 120. With system 200, four floatation components 120A-120D are illustrated with a portion of the total weight (weights 210A-210D) distributed between them. As discussed supra, the number of floatation components 120 to be utilized is not limited and can range from a single floatation component 120 through to a plurality of floatation components N, where N is an integer greater than 1. The weight can be included in a single floatation component 120 or distributed between the N floatation components 120. It is to be appreciated that it is not necessary for all floatation components 120 to have an incorporated weight 210; system 200 can comprise of a combination of floatation component(s) 120 having no incorporated weights and/or floatation components 120 having an incorporated weight.

It is further to be appreciated that the total required weight does not have to be evenly distributed between the floatation components 120, but any given floatation component 120 can include a fraction of the total weight where the fraction ranges from 0% of the total weight to 100% of the total weight. For example, as shown in FIG. 2, system 200 can comprise of four floatation components 120 where the two floatation components 120A and 120B located at the "front" of the loop 115 each contain a larger weight (weights 210A and 210B respectively) than the weights (weights 210C and 210D) respectively incorporated into the two "rear" floatation components 120C and 120D. By having weights 210A and 210B comprise of a greater proportion of the total weight (total weight=210A+210B+210C+210D), owing to mass and momentum effects it is envisioned that the front floatation components 120A and 120B will arrive at a destination slightly ahead of rear floatation components 120C and 120D, which could prevent entanglement of the floatation components 120A-120D and rope 110. Further, it is anticipated that the front floatation components 120A and 120B (and incorporated weights 210A and 210B) will travel ahead of rear floatation components 210C and 210D (and incorporated weights 210C and 210D) as travel of the rear floatation components maybe slightly impeded as a result of the rope 110 paying out of container 100 (where container 100 is utilized) or as a result of the rope 110 moving through the air.

Figure 3:
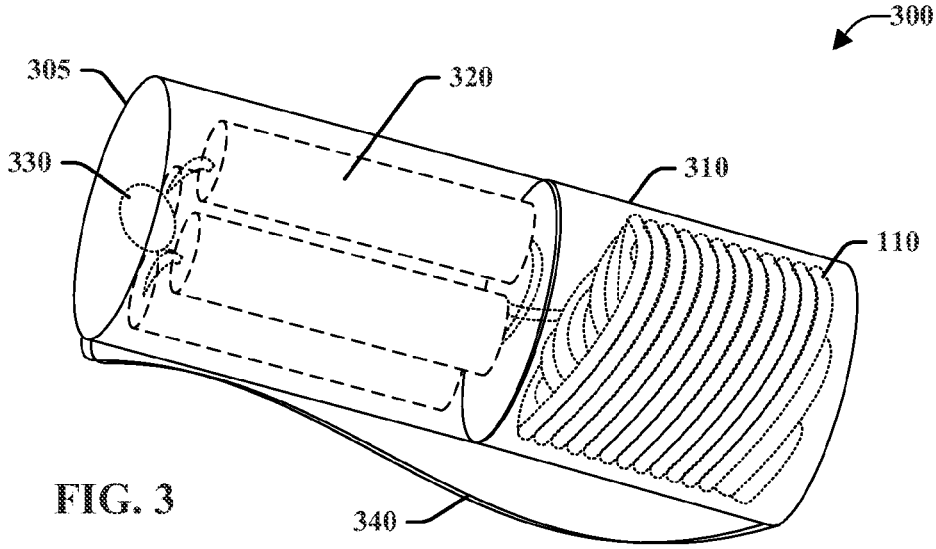
FIG. 3 depicts a system 300 to deliver aid and/or rescue of a person or other entity in accordance with an aspect.
Figure 4:
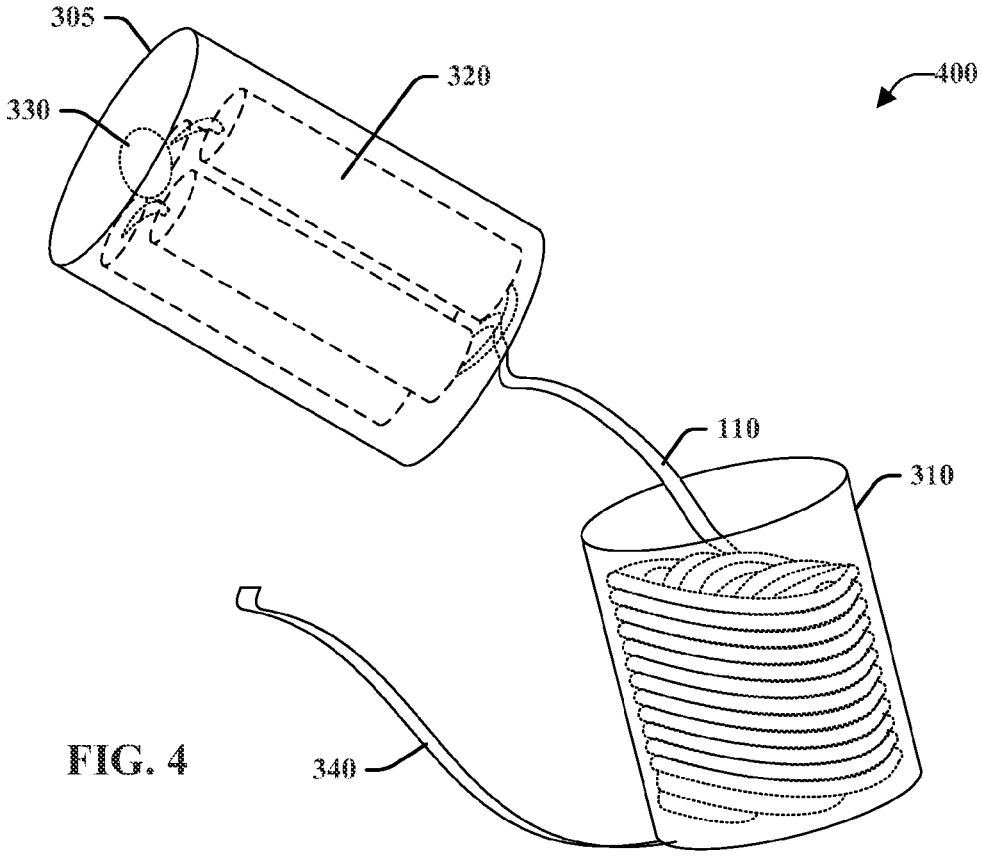
FIG. 4 presents a system 400 to deliver aid and/or rescue of a person or other entity in accordance with an aspect.

FIGS. 3 and 4 illustrate systems 300 and 400 respectively, which are alternative embodiments of systems 100A, 100B and 200 described supra. Subject to the, individual, there is a limit to how far a person can throw an object. To facilitate delivery of the various embodiments of the systems disclosed herein (systems 100A, 100B and 200) over distance, a further delivery device (not shown) can be employed to hurl, throw, project, propel, transport, and the like, systems 100A, 100B and 200 to the required location. Such devices could include, but not limited to, mechanical devices such as a throwstick, slingshot, catapult, trebuchet and the like, a pneumatically operated delivery device such as an aircannon, an explosively operated device such as a cannon, piston actuated, or other device that can impart sufficient momentum/velocity into systems 100A, 100B, or 200 to allow it to be propelled over distance. The delivery device can be portable in nature allowing it to be carried and/or stowed until its use is required. Or the delivery device could be permanently fixed either by coupling the delivery device to a locating bracket to enable removal of the delivery device from the bracket when not in use, or the delivery device can be permanently fixed. In one aspect, the delivery device can allow an embodiment of the safety device (systems 100A, 100B and 200, as described supra) to be employed in situations requiring delivery of the safety device over a distance greater than it can be thrown by an individual. For example, such situations can include delivery of the safety device to a swimmer stranded in surf by a lifeguard (or other person) where the lifeguard is shorebased. In another aspect the delivery system could be carried on a boat, jetski, or the like. The above embodiments are not deemed to be limiting in anyway.

FIGS. 3 and 4 comprise components with functionality comparable or similar to those presented in systems 100A, 100B and 200; a rope 110, floatation components 320, and weight system 330. For ease of discussion, the weight system 330 depicted in FIGS. 3 and 4 is similar to the weightbag 130, weight 140, and connector 150 as presented in systems 100A and 100B, however systems 300 and 400 are not to be considered so limited and any combination of floatation component(s) and weights(s)/weighting system can be utilized. For example, the weight system 330 and floatation components 320 can comprise the weight/floatation component combination as presented in system 200 or any other suitable embodiment.

Systems 300 and 400 include containers 305 and 310, where containers 305 and 310 have comparable functionality to container 100 as presented in systems 100A, 100B and 200. Containers 305 and 310 are used to contain the various components of systems 300 and 400 as well as to aid in the delivery of the safety device system. During transportation/storage of the safety device system, containers 305 and 310 can be attached to provide a single large container. Containers 305 and 310 can be coupled by various suitable means such as a zipper, straps, Velcro, and the like which provide suitable means for attaching containers 305 and 310. In an aspect, suitable floatation material can be incorporated into the container 305 to facilitate extra floatation. In another aspect weighting material can be incorporated into the container 305 to facilitate delivery of the container 305 and various components of systems 300 and 400 contained therein. By incorporating weighted material into the container 305, it may be possible to include no or minimal weight system 330 attached to the rope loop 115 or have minimal or no weight incorporated into the floatation components 320.

In one aspect a carrying handle (not shown) can be provided and/or a carrying strap 340. During use of the safety device system (system 300 or 400) containers 305 and 310 can be separated from each other (e.g., by undoing the coupling device such as the zip, Velcro, etc., as employed). Also, where the carrying strap 340 connects to both containers (305 and 310), the carrying strap 340 can be disconnected from one or both of the containers (305 or 310) to facilitate separation of the containers, as shown in FIG. 4. Any suitable means for connecting the carrying strap 340 can be employed, such as a mechanical release clasp, Velcro fixing, etc.

To facilitate conveyance of the safety device (systems 100A, 100B, 200, 300 and 400) by the delivery device, rather than removing the rope loop 115, floatation component(s) 320, and/or weighting system 330 from container 305 they are left inside. The container 300 including the various system components (e.g., rope 110, rope loop 115, floatation component(s) 320, and weighting system 330) can then be placed onto/into any appropriate delivery device and then, as a single unit, the various system components within the container 300 can be delivered to the desired location. By having the various system components (e.g., rope 110, rope loop 115, floatation component(s) 320, and weighting system 330) contained within the container 300, it is considered that the safety device can be delivered over a distance further and with increased accuracy than if the various system components (e.g., rope 110, rope loop 115, floatation component(s) 320, and/or weighting system 330) were delivered uncontained. By employing the container 310, the mass of the various system components is consolidated and confined to a smaller volume/area than if the various system components were delivered uncontained, thereby the forces affecting the distance and accuracy of delivery are reduced when using the container 310 than without.

Further, the material used to construct the floatation component(s) 320 (and similarly FIGS. 1 & 2, components 120A-D), can be of a material that exhibits "memory" with regard to shape and volume. Such a material could be inserted in the container 310 in a compressed state and upon removal from the container 310 the material expands to an uncompressed state thereby taking on its shape in uncompressed form and as a function of such it's volume is increased, reducing it's density and thereby providing improved floatation properties in comparison with the compressed state. Any material that exhibits such properties can be suitably employed, for example, an open cell polyurethane foam.

Further, the floatation component(s), 120A-120D and 320, can be enveloped in a completely/partially airtight covering, such as an airtight nylon fabric. Where a material having shape and volume memory, as discussed supra, is employed as part of the floatation components 120A-120D and 320 the airtight nylon fabric can be used to prevent ingress of water into the material having shape/volume memory as the material expands to it's uncompressed form. Further, the airtight covering can include valves (not shown) that allow air to fill the volume enclosed by the envelope created by the airtight covering. As the memory material expands to its uncompressed volume air can be drawn through the valve. In an alternative embodiment, the valves can facilitate opening and closed, where the valve is opened to allow air flow into the envelope internal volume and then closed to prevent any more air or other substance from entering the volume. Such valve can be of a simple neck and stopper where the stopper is removed from the neck to open the valve and then re-inserted to close the valve, such valves are commonly employed on inflatable devices to be found at swimming pools and are typically made from rubber or other suitable material. Alternatively, the valve can be of a twist open/close operation where a part of the valve is twisted to open and allow air to enter, and then twisted in the other direction to close the valve to prevent air escaping. Such a valve is typically found on air mattresses as employed by backpackers and the like, and can be made from any suitable material, where such suitable material includes polyoxymethylene (commonly referred to as POM and also known as polyacetal, polyformaldehyde, or DELRIN). An alternative operation of the valve is pull to open, release to close. Any other suitable valve and operation thereof can be employed to facilitate expansion of the floatation components 120A-120D and 320.

As mentioned previously systems 300 and 400 can be employed in a hand held fashion, as well as in combination with a delivery device (not shown). While not shown, systems 300 and 400 can include any necessary attachments to facilitate use with a delivery device, in the form of brackets, couplings, and the like.

FIGS. 5-10 present methodologies for construction of a rescue device to assist in the rescue of a person or other entity. While, for purposes of simplicity of explanation, the methodology is shown and described as a series of acts, it is to be understood and appreciated that the methodology is not limited by the order of acts, as some acts can, in accordance with one or more embodiments, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with one or more embodiments.

Figure 5:
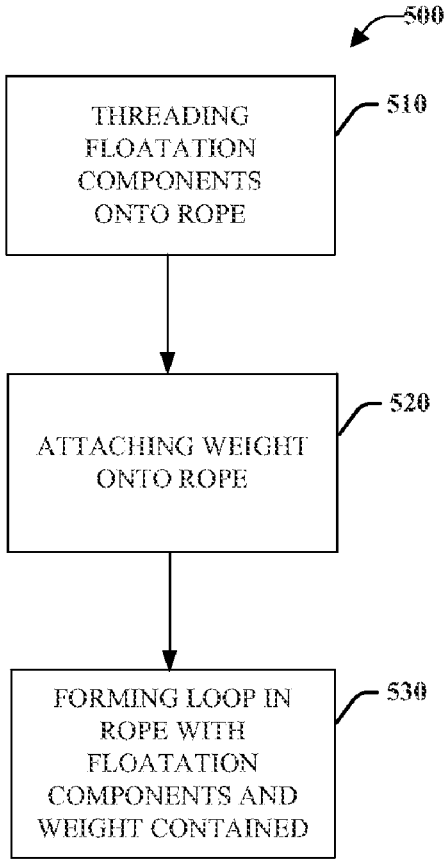
FIG. 5 illustrates a representative methodology 500 for creating a rescue device comprising floatation component(s) and weight in accordance with an aspect.

FIG. 5 presents methodology 500 for construction of a rescue device. At 510 floatation component(s) (e.g., floatation components 120A-120D, 320) are threaded onto a rope (e.g., rope 110). The floatation component(s) can be of tubular form facilitating the threading of a floatation component onto one end of the rope (e.g., rope end 117). The number of floatation components to be utilized can range from a single floatation component through to a plurality of floatation components N, where N is an integer greater than 1.

At 520 a weight (e.g., weightbag 130, weight 140, and connector 150) to facilitate delivery of the rescue device (e.g., rope 110 and floatation components 120A-120D, 320) to a desired location, e.g., the locale of a swimmer in a body of water, is attached to the rope. It is to be appreciated that the weight can be attached to the rope in a specific sequence in accordance with the sequence with which the floatation components are being threaded onto the rope, e.g., two floatation components, followed by the weight, followed by two further floatation components. Alternatively the floatation components can be threaded onto the rope and the weight clipped on with a connector (e.g., connector 150) at a desired position in relation to the threaded floatation components.

At 530, the end of the rope (e.g., rope end 117) can be connected with the rope to form a loop (e.g., loop 115) on which are located the floatation components and the weight. The end of the rope can be connected and secured to the rope by any suitable means such as a knot, splicing, gluing, thermo-connection, and the like. A rescue device comprising a looped rope with floatation components and attached weight is formed.

Figure 6:
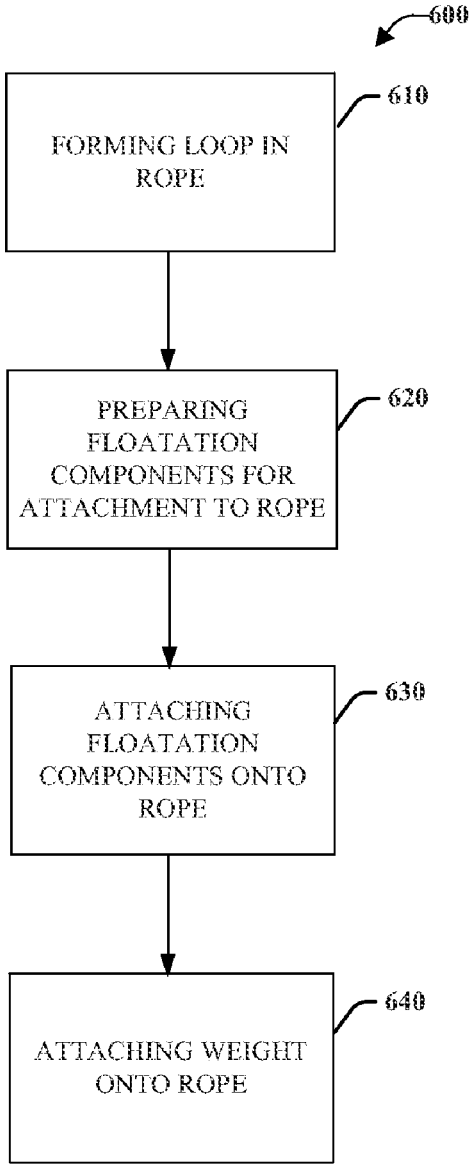
FIG. 6 illustrates an example methodology 600 for creating a rescue device comprising floatation component(s) and weight in accordance with an aspect.

FIG. 6 presents methodology 600 for construction of a rescue device. At 610 a loop (e.g., loop 115) is formed by connecting an end of a rope (e.g., rope end 117) to the rope (e.g., rope 110). The end of the rope can be connected and secured to the rope by any suitable means such as a knot, splicing, gluing, thermo-connection, and the like.

At 620, floatation component(s) (e.g., floatation components 120A-120D, 320) can be prepared for attachment to the rope. In one embodiment, the floatation component(s) can be initially be off tubular form, whereby one side of the tube can be sliced along its length to form a floatation component having a "C" profile.

At 630, the rope can be inserted between the open ends of the "C" profile, whereupon the open ends can be closed resulting in the rope being located inside the closed tubular profile. The ends of the "C" profile can be secured (e.g., by gluing) thereby reforming the tubular profile with the rope passing through the center of the tube. The number of floatation components to be utilized can range from a single floatation component through to a plurality of floatation components N, where N is an integer greater than 1.

At 640, a weight (e.g., weightbag 130, weight 140, and connector 150) to facilitate delivery of the rescue device (e.g., rope 110 and floatation components 120A-120D, 320) to a desired location, e.g., the locale of a swimmer in a body of water, can be attached to the rope loop. The weight can be connected to the rope by any suitable means, e.g., tying on, with a connector, and the like. A rescue device comprising a looped rope with floatation components and attached weight is formed.

Figure 7:
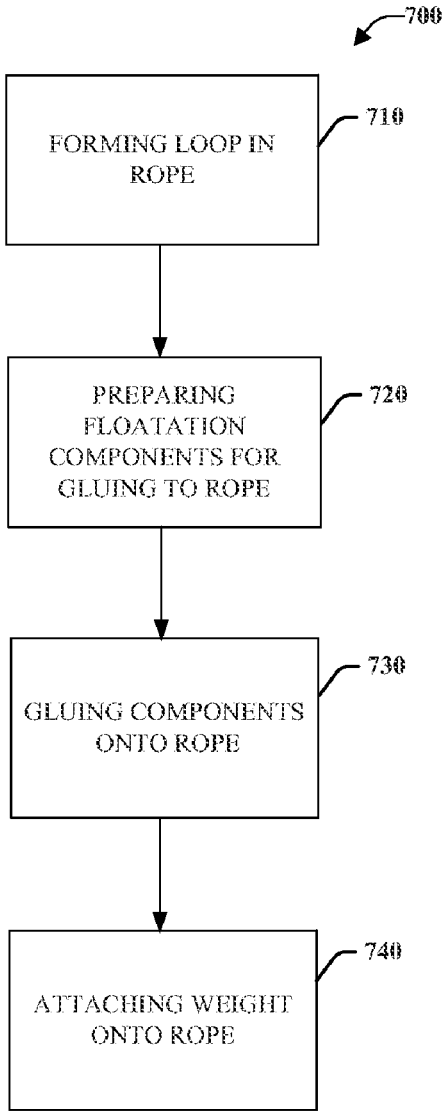
FIG. 7 presents an example methodology 700 for creating a rescue device comprising floatation component(s) and weight in accordance with an aspect.

FIG. 7 presents methodology 700 for construction of a rescue device. At 710 a loop (e.g., loop 115) is formed by connecting an end of a rope (e.g., rope end 117) to the rope (e.g., rope 110). The end of the rope can be connected and secured to the rope by any suitable means such as a knot, splicing, gluing, thermo-connection, and the like.

At 720, floatation component(s) (e.g., floatation components 120A-120D, 320) can be prepared for attachment to the rope, where attachment can be by gluing to the rope. Preparation of the floatation component(s) can include providing a mechanical key (e.g., by chemical, or mechanical means such as abrading) to improve adherence of an adhesive. The number of floatation components to be utilized can range from a single floatation component through to a plurality of floatation components N, where N is an integer greater than 1.

At 730, a requisite number of floatation components can be glued, adhered, bonded, and the like, to the rope. While methodology 600 relates to floatation components having a tubular profile, methodology 700 can further involve floatation components having any suitable profile facilitating attachment to the rope. For example, a floatation component can be comprised of a plurality of sections which can be glued together to form a requisite floatation component.

At 740, a weight (e.g., weightbag 130, weight 140, and connector 150) to facilitate delivery of the rescue device (e.g., rope 110 and floatation components 120A-120D, 320) to a desired location, e.g., the locale of a swimmer in a body of water, can be attached to the rope loop. The weight can be connected to the rope by any suitable means, e.g., tying on, with a connector, and the like. A rescue device comprising a looped rope with floatation components and attached weight is formed.

Figure 8:
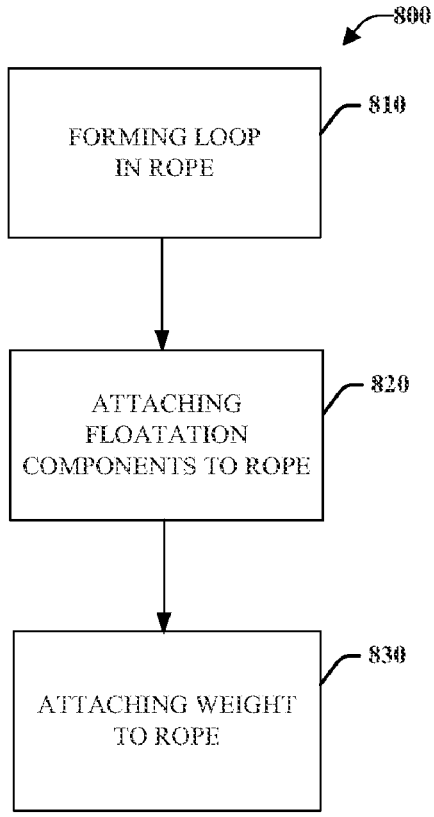
FIG. 8 illustrates an example methodology 800 for creating a rescue device comprising floatation component(s) and weight in accordance with an aspect.

FIG. 8 presents methodology 800 for construction of a rescue device. At 810 a loop (e.g., loop 115) is formed by connecting an end of a rope (e.g., rope end 117) to the rope (e.g., rope 110). The end of the rope can be connected and secured to the rope by any suitable means such as a knot, splicing, gluing, thermo-connection, and the like.

At 820, floatation component(s) (e.g., floatation components 120A-120D, 320) can be attached to the rope, where such attachment can include any suitable means such as clipping on, tying on, and the like. The number of floatation components to be utilized can range from a single floatation component through to a plurality of floatation components N, where N is an integer greater than 1.

At 830, a weight (e.g., weightbag 130, weight 140, and connector 150) to facilitate delivery of the rescue device (e.g., rope 110 and floatation components 120A-120D, 320) to a desired location, e.g., the locale of a swimmer in a body of water, can be attached to the rope loop. The weight can be connected to the rope by any suitable means, e.g., tying on, with a connector, and the like. A rescue device comprising a looped rope with floatation components and attached weight is formed.

Figure 9:
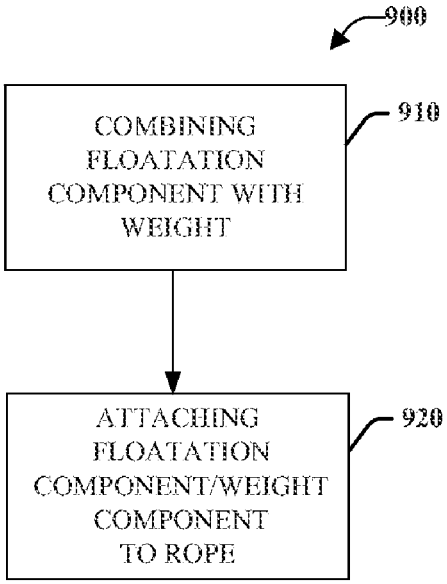
FIG. 9 presents an example methodology 900 for combining a floatation component(s) and weight for a rescue device in accordance with an aspect.

FIG. 9 presents methodology 900 for construction of a rescue device. At 910 weighted mass (e.g., weights 210A-210D) are incorporated into one or more floatation component(s) (e.g., floatation components 120A-120D). Rather than having a single weight (e.g., weightbag 130, weight 140, and connector 150) the required weight to facilitate delivery of the rescue device can be distributed between the one or more floatation components. The number of floatation components to be utilized can range from a single floatation component through to a plurality of floatation components N, where N is an integer greater than 1. Similarly, the number of weighted mass can range from a single weight through to a plurality of weights N, where N is an integer greater than 1.

At 920, floatation component(s) and combined weight(s) can be attached to a rope (e.g., rope 11). The rope can have already been configured to form a loop (e.g., loop 115) and the floatation component(s) and combined weight(s) can be attached thereon by such means as gluing, tying on, locating with a connector, and the like. Alternatively the floatation component(s) and combined weight(s) can be threaded onto the rope and secured in place by forming a loop as described above.

Figure 10:
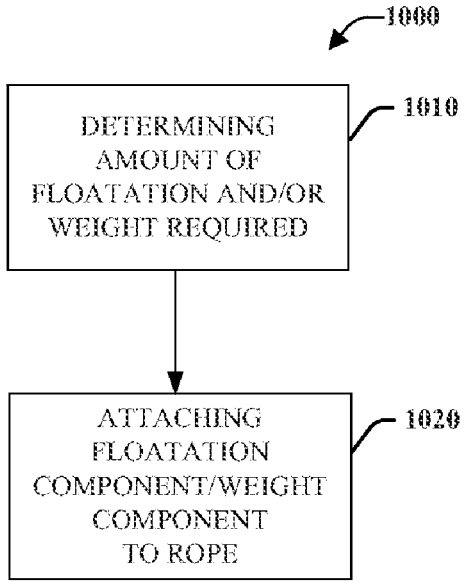
FIG. 10 illustrates an example methodology 1000 for determining and attaching required floatation component(s) and weight for a rescue device in accordance with an aspect.

Turning to FIG. 10, illustrated is methodology 1000 for construction of a rescue device. At 1010, rather than a rescue device being manufactured and distributed having a fixed amount of floatation (e.g., provided by floatation components 120A-120D, 320) and weight to facilitate delivery of the rescue device (e.g., rope 110 and floatation components 120A-120D, 320) to a desired location, e.g., the locale of a swimmer in a body of water, a plurality of floatation component(s) and weights can be provided. Based upon the application in which the rescue device is going to be employed, e.g., at a swimming pool with children swimmer(s), adult swimmer(s), whitewater kayaking, sailing, etc., the required weight to facilitate rescue of an individual in a particular circumstance can be determined. For example, the necessary weight to provide sufficient floatation assistance to a child swimmer can be less than that required for an adult. Accordingly, less weight may be required to deliver a rescue device having less floatation attached thereto.

At 1020 the determined amount of floatation component(s) and weight(s) is attached to the rope. The rope can have already been configured to form a loop (e.g., loop 115) and the floatation component(s) and weight(s) can be attached thereon by such means as gluing, tying on, locating with a connector, and the like. Alternatively the floatation component(s) and combined weight(s) can be threaded onto the rope and secured in place by forming a loop as described above.

What has been described above includes examples of the subject specification. It is, of course, not possible to describe every conceivable combination of components or methodologies for purposes of describing the subject specification, but one of ordinary skill in the art can recognize that many further combinations and permutations of the subject specification are possible. Accordingly, the subject specification is intended to embrace all such alterations, modifications and variations that fall within the spirit and scope of the innovations disclosed.

What is claimed is:

1. A system to facilitate rescue, comprising:

a length of rope, wherein a looped end is formed on the length of rope by attachment of one end of the length of the rope to a point along the length of the rope;

at least two floatation components located on the looped end of rope; and at least one weight to facilitate delivery of the looped end of rope and the at least two floatation components, wherein the at least one weight comprises a bag containing weighting material.

2. The system of claim 1, wherein the at least two floatation components are threaded onto a portion of the length of rope comprising the looped end of rope prior to formation of the looped end of rope.

3. The system of claim 1, wherein the weighting material is a particulate.

4. The system of claim 1, wherein the at least two floatation components are glued onto the looped end of rope.

5. The system of claim 1, wherein the bag is re-sealable to enable weighting material to be added to the bag.

6. The system of claim 1, wherein the bag is attached to the looped end of the rope by at least one of a karabiner, ziptie, rope, or string.

7. The system of claim 1, wherein the at least two floatation components are of substantially the same shape.

8. The system of claim 1, wherein the at least two floatation components are separately located on the looped end of the length of rope.

9. The system of claim 1, wherein the looped end formed on the length of rope is of a magnitude to facilitate placement of the looped end over an object, the object is disparate the system.

10. The system of claim 9, wherein the object is at least one of a person or other entity.

11. The system of claim 1, wherein the looped end formed on the length of rope and the at least two floatation components located on the looped end of rope are arranged to form a torus shape.

12. The system of claim 1, further comprising a storage container, the storage container comprising a first container and a second container, wherein the first container and second container are attached together to form the storage container and the storage container is of a size to accommodate the length of rope, the at least two floatation components and the at least one weight.

13. The system of claim 3, wherein the particulate is at least one of sand, dirt, pebbles, lead shot, polymer shot, or glass beads.

14. The system of claim 1, wherein the at least two floatation components are straight tubes.

15. The system of claim 1, wherein the at least two floatation components are curved tubes.

* * * * *